US007036229B1

(12) United States Patent
Demko

(10) Patent No.: US 7,036,229 B1
(45) Date of Patent: May 2, 2006

(54) SELF OPENING FOLDING KNIFE

(76) Inventor: Andrew Demko, 317 Sampson St., New Castle, PA (US) 16101

( * ) Notice: Subject to any disclaimer, the term of this patent is extended or adjusted under 35 U.S.C. 154(b) by 50 days.

(21) Appl. No.: 10/829,077

(22) Filed: Apr. 22, 2004

(51) Int. Cl.
*B26B 1/02* (2006.01)

(52) U.S. Cl. ..... 30/160

(58) Field of Classification Search ..... 30/160, 30/161, 159
See application file for complete search history.

(56) References Cited

U.S. PATENT DOCUMENTS

| | | | | |
|---|---|---|---|---|
| 4,095,337 | A | 6/1978 | Pharr | |
| 5,009,008 | A | 4/1991 | Yablonovitch | |
| 5,802,722 | A | 9/1998 | Maxey et al. | |
| 5,878,500 | A | 3/1999 | Emerson | |
| 6,397,476 | B1 | 6/2002 | Onion | |
| 6,834,432 | B1 * | 12/2004 | Taylor, Jr. | 30/161 |
| 2003/0046818 | A1 * | 3/2003 | Glesser | 30/161 |
| 2003/0226260 | A1 * | 12/2003 | Sullivan | 30/160 |

* cited by examiner

*Primary Examiner*—Charles Goodman
(74) *Attorney, Agent, or Firm*—Harpman & Harpman

(57) ABSTRACT

A folding knife that provides for a self-opening action as is drawn from the pocket of a user. The knife has a hinged knife blade positioned to be folded into a handle portion for storage when not in use. A blade opening element is mounted on the closed exposed edge of the blade adjacent the handle portion and extends both transversely and longitudinally from the blade so as to be engageable with a portion of the pocket when it is to be retrieved therefrom or by manual manipulation by the user.

4 Claims, 3 Drawing Sheets

SELF OPENING FOLDING KNIFE

BACKGROUND OF THE INVENTION

1. Technical Field

This invention relates to folding pocket knives and specifically to devices associated therewith for the rapid opening thereof without specific engagement of the blade by the user.

2. Description of Prior Art

Prior art devices of this type have relied on a variety of different folding knife blade configurations, all of which have an extension from their blades to assist with opening, see for example U.S. Pat. Nos. 4,095,337, 5,009,008, 5,802,727, 5,878,500 and 6,397,476.

In U.S. Pat. No. 4,095,337 a finger actuator for folding blades is described wherein a compound clip configuration is selectively attached to the blade edge portion of a blade having an upstanding thumb engagement lever extending therefrom.

U.S. Pat. No. 5,009,008 shows a thumb actuator device for a folding knife. The device is secured to the blade by a set screw providing an upstanding actuation lug thereon.

U.S. Pat. No. 5,802,722 claims a one-handed knife in which a thumb pin extends from one side surface of the blade in both closed and opened positions.

U.S. Pat. No. 5,878,500 is directed to a self-opening folding knife which has a portion of the blade being contoured to form a hook shaped projection on its non-sharpened edge adjacent the hinge pin of the handle.

U.S. Pat. No. 6,397,476 discloses a knife having an opening and closing assisting mechanism in which a thumb barb extends from the side of the blade below the back edge for manual engagement by the user to open the blade.

SUMMARY OF THE INVENTION

A self-opening folding knife which is deployable when removed from a pocket. The knife includes a pivot blade which is selectively retained within a handle with an engageable opening tab thereon. The opening tab extends both longitudinally and transversely beyond the tab's mounting surface on the blade to which it is secured. When the knife is pulled from within a pocket, the engagement tab will catch a portion of the pocket pulling the blade to an open locked position in a continuous automated manner.

DESCRIPTION OF THE PREFERRED EMBODIMENT

Figure 1:
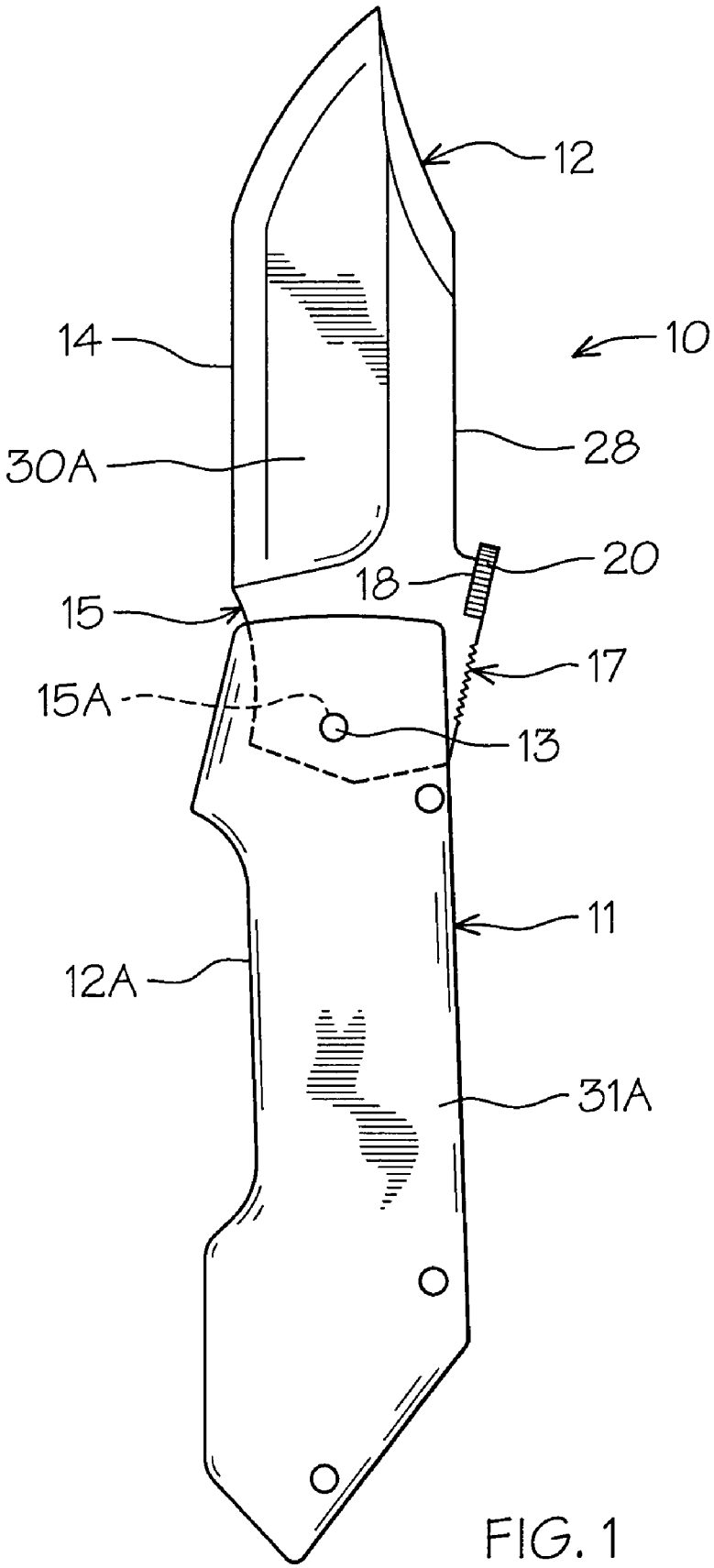
FIG. 1 is a side elevational view of the self-opening knife in the open position.
Figure 2:
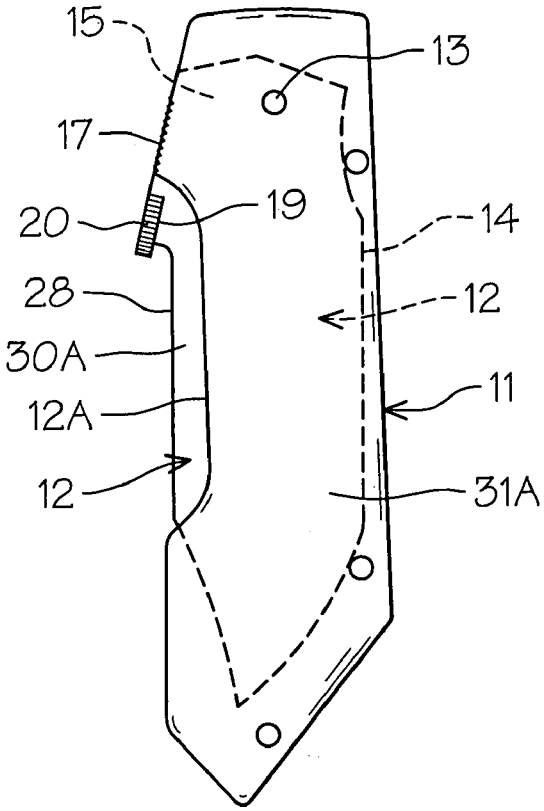
FIG. 2 is a side elevational view of the self-opening knife in closed position.
Figure 3:
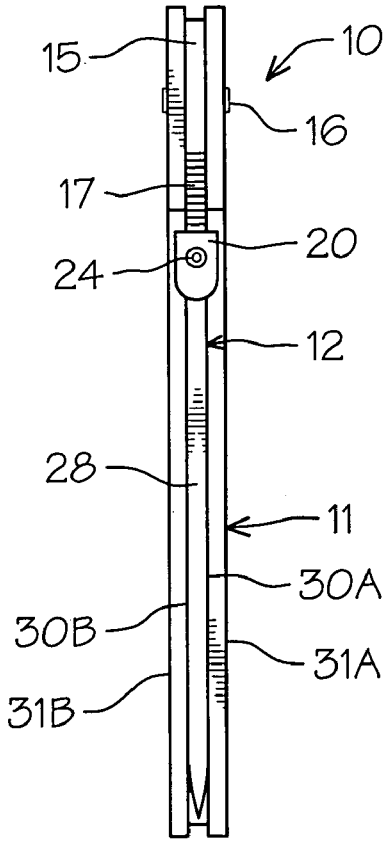
FIG. 3 is an end elevational view on lines 3—3 of FIG. 2.

Referring to FIGS. 1, 2 and 3 of the drawings, a folding knife 10 can be seen having a handle portion 11 with a blade 12 pivotally secured via a hinge pin 13 within as that which is manually deployed for a folding knife configuration. The blade 12 is disposed within a blade retention slot 12A defined within the handle portion 11 so that sharpened edge 14 of the blade 12 is safely enclosed therewithin. The blade 12 has a shank portion 15 which is apertured at 15A (shown in dotted lines in FIGS. 1 and 2 of the drawings) through which the hinge pin 16 registerably extends pivotally securing the blade 12 to the hereinbefore described handle portion 11. A portion 17 of the blade shank 15 which extends from the handle portion 11 when in opened or closed position is in angular disposed relation to the longitudinal axis of the blade 12. A notch 18 is formed within the extended shank portion 17 defining a mounting surface area 19 thereon in which an engagement tab 20 of the invention is positioned as best seen in FIGS. 4 and 5 of the drawings.

The engagement tab 20 is of a generally flat rectangular configuration having an arcuate end edge 21 having a textured engagement surface 21A thereon that extends to and along the respective oppositely disposed parallel side edges 22A and 22B. The engagement tab 20 of the invention is of a longitudinal and transverse dimension greater than that of the blades tab mounting surface area 19 so as to provide bilateral and longitudinal engagement areas therebeyond.

The engagement tab 20 of the invention is centrally apertured at 23 for receiving a threaded fastener 24 therethrough and threadable engagement in a corresponding threaded aligned bore 25 in the mounting surface area 19 as set forth previously.

Figure 4:
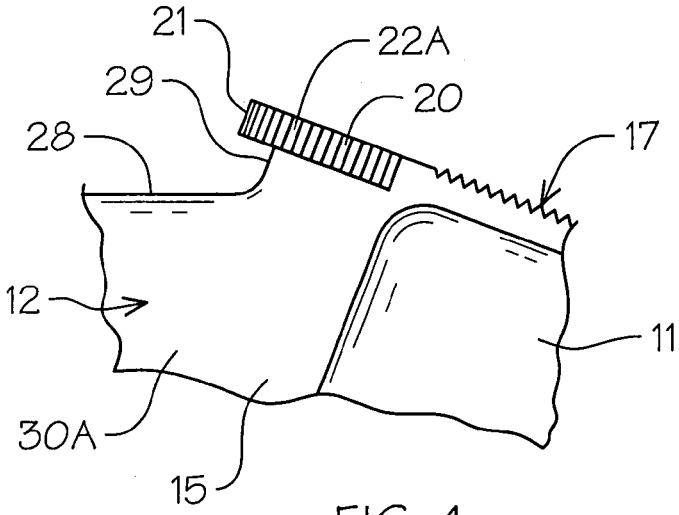
FIG. 4 is an enlarged partial side elevational view of the opening tab extending from the blade.
Figure 5:
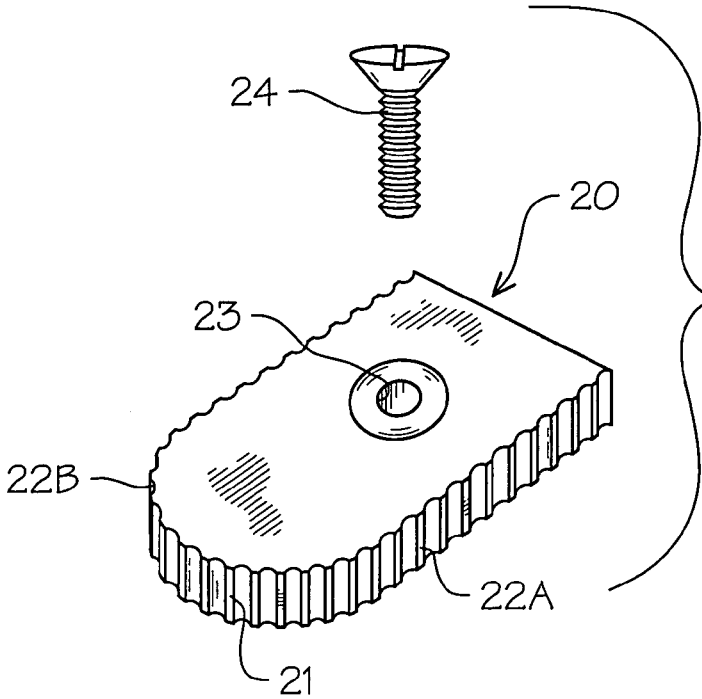
FIG. 5 is an enlarged perspective view of the opening tab of the invention removed from the knife blade.

It will be seen that the arcuate edge 21 of the engagement tab 20 of the invention extends beyond a respective edge 27 of the mounting surface area 19 as seen in FIG. 4 of the drawings defining a projection in spaced relation to a back edge 28 of the blade 12. This arrangement effects an auto opening of the blade 12 from closed stored position as illustrated in FIGS. 2 and 3 of the drawings when the knife is withdrawn from within a containment such as a clothing pocket indicated by broken lines P in FIG. 3 of the drawings.

The knife 10 is oriented within the pocket P so that when it is rapidly withdrawn in a single continuous motion, the engagement tab 20 of the invention will selectively engage a portion of same as indicated, causing the blade 12 to unfold about the hinge pin 16 and fully open and lock position as illustrated in FIG. 1 of the drawings. Alternately, given that the engagement tab 20 of the invention extends not only longitudinally beyond a mounting surface front edge 27, but also extends transversely therebeyond, it provides for selected tactical engagement by user indicated by arrows U along the respective blade and handle side surfaces 30A and 30B and 31A and 31B.

It will be seen that the respective oppositely disposed side portions of the handle 11 are of reduced transverse dimension at 32A and 32B so that as to afford ease of user tactical engagement as hereinbefore described. As noted, in use, the user can grasp the distal end portion of the closed knife 10 within a pocket P and remove the knife 10 rapidly in which the engagement tab 20 will snag a portion of the pocket P forcing the blade 12 open in a quick smooth action.

It will thus be seen that a new and novel self-opening folding knife configuration has been illustrated and described and it will be obvious to those skilled in the art that various changes may be made without departing from the spirit of the invention.

Therefore I claim:

1. A self-opening folding knife comprises, an elongated handle portion with an elongated knife blade extending therefrom, said knife blade having an elongated sharp edge portion and an oppositely disposed back edge portion, said knife blade having a shank end portion and a tip end, said shank end portion pivotally secured from within said handle portion for movement of said blade from a first closed position within said handle to a second locked open position, said shank end portion having an upper edge surface extending from said handle portion in angularly disposed relation to said blade's back edge portion, a notch in said upper edge surface defining a recessed mounting edge surface in vertically offset spaced relation to said blade's back edge portion, an engagement tab secured on and extending beyond a said recessed mounting surface on the upper edge surface of said shank end portion of said blade, said engagement tab extending longitudinally and transversely beyond said recessed mounting edge surface in co-planar relation to said shank end portion upper edge surface.

2. The self-opening knife blade set forth in claim 1 wherein said engagement tab has an arcuate free end in offset vertical spaced relation to said blade's back edge portion.

3. The self-opening folding knife set forth in claim 2 wherein said engagement tab's arcuate free end has a textured engageable edge surface thereon extending to and including oppositely disposed spaced parallel exposed edges of said engagement tab extending bi-laterally therefrom.

4. The self-opening folding knife set forth in claim 1 wherein said engagement tab has a mounting aperture therein for registration of a fastener therethrough into an aligned threaded bore in said recessed edge mounting surface.

* * * * *